US006932325B1

(12) United States Patent
Selcer et al.

(10) Patent No.: US 6,932,325 B1
(45) Date of Patent: Aug. 23, 2005

(54) ACTIVE-OVER-PASSIVE COORDINATED MOTION WINCH

(75) Inventors: Toby Selcer, College Station, TX (US); James Stasny, College Station, TX (US)

(73) Assignee: Dynacon, Inc., Bryan, TX (US)

( * ) Notice: Subject to any disclaimer, the term of this patent is extended or adjusted under 35 U.S.C. 154(b) by 0 days.

(21) Appl. No.: 10/782,721

(22) Filed: Feb. 18, 2004

(51) Int. Cl.[7] ..... B66D 1/50

(52) U.S. Cl. ..... 254/275; 414/137.7; 414/138.2; 414/139.6; 212/308

(58) Field of Search ..... 254/275, 277, 254/274, 360; 414/137.7, 138.2, 139.6; 212/308

(56) References Cited

U.S. PATENT DOCUMENTS 4,354,608 A * 10/1982 Wudtke ..... 212/308
4,544,137 A * 10/1985 Johnson ..... 254/337
4,593,885 A * 6/1986 Hackman et al. ..... 254/277
4,632,622 A * 12/1986 Robinson ..... 414/139.6
5,028,194 A * 7/1991 Robinson ..... 414/139.6
5,114,026 A * 5/1992 Van Ketel Hendrik ..... 212/308
5,511,922 A * 4/1996 Sekiguchi et al. ..... 414/139.6
5,685,683 A * 11/1997 Becker et al. ..... 414/141.1
6,082,947 A * 7/2000 Adamson ..... 414/137.7
6,601,649 B2 * 8/2003 Beato et al. ..... 166/352

* cited by examiner

*Primary Examiner*—Emmanuel M Marcelo
(74) *Attorney, Agent, or Firm*—McHale & Slavin, P.A.

(57) ABSTRACT

The instant invention is directed to a active-over-passive coordinated motion winch designed to be used in combination with a class of existing offshore lifting systems such as A-Frames, booms or cranes to minimize the relative movement between a payload position and a destination position occurring commonly in offshore operations. The configuration of this system allows a remote operated vehicle (ROV) or any other launched load to be firmly captured until it is delivered to the desired destination. The configuration of the system also permits towed loads, such as sonar devices, to closely maintain level tow paths along the sea floor.

15 Claims, 1 Drawing Sheet

ACTIVE-OVER-PASSIVE COORDINATED MOTION WINCH

FIELD OF THE INVENTION

This invention relates to an active-over-passive coordinated motion winch; particularly to an active-over-passive coordinated motion winch suited for minimizing the relative movement between a payload position and a destination position occurring commonly in offshore operations.

BACKGROUND OF THE INVENTION

One of the challenges in working on offshore operations is dealing with the constant motion due to the ocean's waves. The constant heaving and surging of the waves presents numerous challenges to those involved in the transfer of payloads from ships or platforms to positions on or below the ocean's surface.

In a typical lowering situation, the payload is first lifted off the deck of a ship using a winch having a cable running through a sheave rotatably mounted on an A-frame or crane boom. The crane or A-frame luffs overboard and the winch cable is paid out to lower the load. Once the payload touches the peaks of the waves, the ocean's influence causes relative motion between the ocean's surface and the object being moved. The relative motion engendered between the ocean's surface and the object being moved must be taken into account and compensated for to accurately deliver the payload. Movement of towed loads that travel close to the ocean floor represent a risky endeavor for many reasons, one of which is that large relative degrees of motion are induced into the towed load due to the ship's response to movement of the water's surface. Docking or maneuvering an object suspended from a ship's crane or other lifting device near fixed objects, in the ocean or on the ocean floor, is nearly impossible unless special means are taken to reduce or eliminate the relative motions. Additionally, when the relative motions are in excess of the load's terminal velocity in the water, snap loads occur in the lowering cable. These snap loads are dangerous to the survival of the cable, its terminations, and to the load and lifting device in general. Since these relative motions increase with increasing seas, the range of weather in which these lowering operations can be carried out is restricted. Since larger ships induce smaller motions, larger ships are often required for critical lowering operations.

Various heave compensation devices have been proposed in an effort to overcome these difficulties. These devices generally attempt to maintain the load in a more or less fixed position relative to the earth, regardless of the motions that the ship is undergoing by creating reciprocal movements in the lowering cable in an attempt to compensate for the relative motion. Control of these devices may be either passive or active, with relative expense, space and weight considerations being deciding factors in this regard. Various mechanisms have been utilized in attempting to raise and lower the required amount of cable to produce the reciprocal movements, including active winch drums, flying sheaves, and nodding booms.

PRIOR ART

U.S. Pat. No. 4,593,885 discloses a motion compensating device which is installed on a lift line and situated between a crane and an object to be lifted. The device consists of a hydraulic system and sheave mechanical system arrangement together with a balancing system for a given load range.

U.S. Pat. No. 4,354,608 discloses a motion compensating device for a crane hoist. A counterweight, connected to the reeving system, maintains a level of pretension upon the line. A hydraulic cylinder provides a cushioning effect at both ends of the counterweights travel and allows locking movement of the counterweight.

U.S. Pat. No. 4,544,137 provides a motion-compensated lifting apparatus which provides a traveling weight for maintenance of tension upon the load-lifting member, and a locking mechanism for prevention of movement of the traveling weight in one direction. Load direction sensing devices prevent lifting when the vessel is falling.

U.S. Pat. No. 4,632,622 provides an apparatus for transferring cargo including a pivotally connected linkage for connecting two locations so as to accommodate relative movement therebetween. Interaction of the linkage via the use of hydraulic cylinders articulates a compensating motion between the two locations.

U.S. Pat. No. 5,685,683 teaches a system for unloading bulk material from a ship. A float is positioned in the water transverse from and intermediate the ship and a stationary land-fixed location. An outer intake end of a pivotal bulk conveyor on the float is supported and maintained at a fixed height above the body of water and adjacent the ship. An opposite inner outlet end of the pivotal bulk conveyor on the float is supported at a fixed height above the stationary location. As the material is moved, it is transferred to an intermediate bunker car which is moved synchronously longitudinally with the pivotal bulk conveyor and the bucket conveyor.

U.S. Pat. No. 5,028,194 is drawn to a marine crane having an additional controllable variable lifting capability which is operably connected with the crane's load line and separately connected to the surface upon or from which an object is being lowered or lifted. The motion of the crane is compensated to provide for safe initial lifting of cargo from a supply vessel in response to wave action.

U.S. Pat. No. 5,114,026 describes a hoisting device including a cable controlled conventional crane winch assembly which operates in conjunction with a traction winch assembly inclusive of a traction device and storage winch. The use of the crane winch and traction winch assembly, in concert, enables both critical and long haul travel of cargo.

U.S. Pat. No. 5,511,922, teaches a cargo loading and unloading system. A transport car carrying weight enters the ship through a gunwale opening via a ramp. A lift table, which permits the car to board, is positioned by various raising and lowering mechanisms and sensors which operate under the direction of a controller mechanism. Ramp angle and horizontality are maintained within fixed limits irrespective of the relative displacement of the ship's hull with respect to the adjacent wharf, so as to maintain smooth operation of the transport car between the wharf and lift table.

Although the specialized loading and unloading equipment listed above does have the ability to partially compensate for the wave motion, they also have a number of disadvantages. One disadvantage is the complexity and mass of many of these systems which limits their usefulness and the environments in which they can be utilized. A disadvantage of completely passive systems is they are only able to compensate for a portion of the relative motion incurred by most payloads. A disadvantage of completely active systems is they require enormous amounts of horsepower once there is a significant overboard load. Additionally, completely active systems attempting to predict a ship's motion have failed to compensate for conditions such as rogue waves. Loss of feedback with either type of these systems results in dangerous conditions for operators as there is no back-up system to compensate for snap loads.

Accordingly, what is lacking in the art is an active-over-passive coordinated motion winch. The active-over-passive coordinated motion winch should include a primary passive heave compensation assembly and a secondary active heave compensation assembly. The passive assembly should cooperate with a control assembly to substantially carry the load and passively compensate for a large portion of motion due to the ocean's waves. The active assembly should cooperate with the passive assembly and actively compensate for at least a portion of the remaining wave motion.

SUMMARY OF THE INVENTION

The instant invention is directed to an active-over-passive coordinated motion winch designed to be used in combination with a class of existing offshore lifting systems such as A-Frames, booms or cranes. The configuration of this new system allows a remote operated vehicle (ROV) or any other launched load to be firmly captured until it is delivered to the desired destination. The configuration of the system also permits towed loads, such as sonar devices, to closely maintain level tow paths along the sea floor. This greatly enhances data acquired from such towed instrument packages, especially when used for bottom mapping and/or search and discovery missions.

The winch assembly includes a drum having a hub defining an axis of rotation and a pair of flanges at opposing ends of the hub and perpendicular to the axis of rotation. Mechanically linked to the drum is a control assembly, a passive heave compensator and an active heave compensator to provide selective rotation to the drum. The passive heave compensator assembly cooperates with the control assembly to substantially carry the weight of the payload and compensate for a substantial amount of the ocean's wave movement. The active heave compensation assembly is constructed and arranged to monitor various parameters within the winch assembly and the passive heave compensation assembly, process the feedback with a computer and apply rotational force or braking force to the winch drum for enhanced stabilization of the payload in all zones of ocean operation.

There are five distinct zones of the ocean that each provides problems for ship operations that involve lowering payloads into the water. These same zones affect towed systems equally. They are as follows:

Zone I: SPLASH ZONE which is comprised of the distance from the crest of the wave down to the trough of the wave plus two times the height of the package.

Zone II: NEAR SURFACE which begins once the package is lowered below the trough of the waves. It's ending is somewhat vague but is typically approximately 200' to 300' in depth.

Zone III: WATER COLUMN is basically the water between the ending on Zone II and Zone IV.

Zone IV: NEAR BOTTOM is the last 50' of water depth before landing the package on the sea floor.

Zone V: the deepest point, the last 15" and landing on the sea floor.

Offshore operations vary depending on what the requirements of that particular job are. They can involve operations at any or all of the zones listed above. It is important to remember that the package must pass through these zones on its way to and from the deepest point of the operations. Each zone offers its own set of distinct problems and motion compensation reduces most of the detrimental effects.

By utilizing the aforementioned construction, the relative movement between the payload position and the destination position can be substantially neutralized, regardless of whether the payload is neutral (weightless in water), or negative (has weight in water) in all of the aforementioned zones of operation.

In addition, because the active heave compensation assembly only needs to supplement the passive portion of the system, horsepower requirements are reduced allowing this portion of the system to be built much smaller and lighter than previous active systems. The aforementioned construction also provides increased safety when compared to prior art active systems. In the event the active heave compensation portion of the instant invention fails, the system reverts to a passive heave compensation system.

Accordingly, it is a primary objective of the present invention to teach a coordinated motion compensating winch system for use in a marine environment to instantaneously position a load and thereby neutralize relative movement between a payload position and a destination position.

Another objective of the instant invention is to teach a coordinated motion compensating winch system for use in a marine environment which utilizes a primary passive heave compensating assembly to substantially neutralize relative movement between a payload position and destination position.

Yet another objective of the instant invention is to teach a coordinated motion compensating winch system for use in a marine environment having a secondary active heave compensating assembly to dynamically enhance the primary passive heave compensating assembly to substantially neutralize relative movement between a payload position and destination position.

Other objectives and advantages of this invention will become apparent from the following description taken in conjunction with the accompanying drawings wherein set forth, by way of illustration and example, certain embodiments of this invention.

The drawings constitute a part of this specification and include exemplary embodiments of the present invention and illustrate various objectives and features thereof.

DETAILED DESCRIPTION OF THE PREFERRED EMBODIMENT

Figure 1:
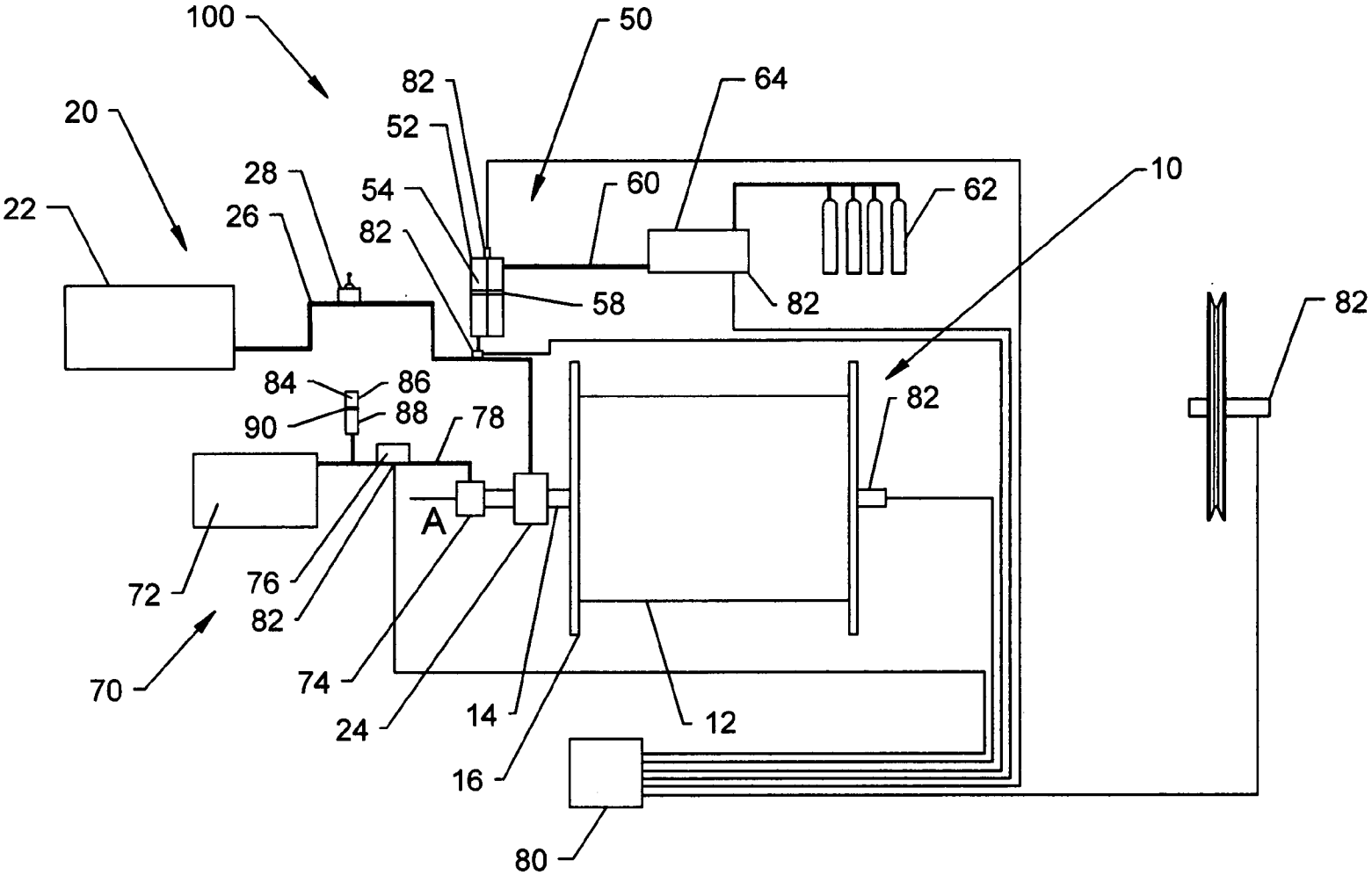
FIG. 1 is a block diagram illustrating the instant invention.

Although the invention will be described in terms of a specific embodiment, it will be readily apparent to those skilled in this art that various modifications, rearrangements and substitutions can be made without departing from the spirit of the invention. The scope of the invention is defined by the claims appended hereto.

Referring to FIG. 1, a block diagram for an active over passive coordinated motion winch device of the instant invention is illustrated generally at 100. The active over passive coordinated motion winch is particularly suited for use in a marine environment to position a payload and neutralize relative movement between a payload and a destination position. The instant invention winch generally includes a winch assembly 10, a control assembly 20, a passive heave compensation assembly 50 and an active heave compensation assembly 70.

The winch assembly 10 includes a drum 12, said drum having a hub 14 defining an axis of rotation A and a pair of flanges 16 at opposing ends of said hub and perpendicular to said axis of rotation. The drum and flanges cooperate to facilitate storage, take up and pay out of one or a group of flexible elongate member(s) (not shown) in continuous evenly distributed coils as is well known in the art. Suitable flexible elongate members may include, but should not be limited to, wire rope cables, ROV umbilical cord, communications cable, combinations thereof and the like.

The control assembly 20 is generally constructed and arranged to selectively and operatively engage the winch assembly 10 whereby variable torque and rotational speed or free rotation of said drum 12 is provided. A main hydraulic power unit 22 is fluidly connected via a primary supply tube 26 to supply pressurized liquid to a primary hydraulic motor 24. The primary hydraulic motor is mechanically connected to the drum 12 by means well known in the art for providing selective power assisted rotational movement thereto. A directional control valve 28 is fluidly connected along the primary supply tube 26 between the main hydraulic power unit 22 and the primary hydraulic motor 24. The directional control valve is constructed and arranged for infinitely variable positioning capability. Thus it can control the direction of fluid flow through the main hydraulic motor as well as the amount of fluid allowed to flow through the main hydraulic motor. Operation of the directional control valve 28 in a first direction permits the pressurized liquid to flow from the hydraulic power unit 22 to the primary hydraulic motor 24, via the primary supply tube 26, to rotate the primary hydraulic motor 24 in a first direction; and operation of the directional control valve in a second direction causes the primary hydraulic motor to rotate in a second direction. Directional control valves either mechanical, electro-mechanical, pneumatic-mechanical, servo-mechanical or suitable combinations thereof, that are suitable for infinitely controlling hydraulic fluid flow are well known in the art. In the preferred non-limiting embodiment the directional control valve utilized is a manually actuated, spring-centered, three way valve.

The passive heave compensation assembly designated generally at 50 includes means for providing passive coordinated reciprocal movement between the payload position and the destination position. The means for providing passive coordinated reciprocal movement between said payload position and said destination position generally includes a gas spring accumulator 52. The gas spring accumulator includes a variable volume gas portion 54 and a variable volume oil portion 56, said gas portion and said oil portion being separated by a piston member 58. The gas portion 54 is fluidly coupled to an infinitely variable gas pressure source via a gas supply tube 60. The gas pressure source illustrated herein as at least one tank 62 filled with compressed fluid. The oil portion 56 is fluidly coupled to said primary supply tube 26 preferably between the primary hydraulic motor 24 and the directional control valve 28. The gas spring accumulator 52 is constructed and arranged to passively dampen response of the winch drum 12 thereby reducing relative movement between the payload position and destination position. The means for providing passive coordinated reciprocal movement between the payload position and the destination position may also include a gas intensifier 64 fluidly connected to the gas supply tube 60 preferably between the gas pressure source 62 and the gas portion 54 of the gas spring accumulator 52. The gas intensifier 64 is constructed and arranged to accept pressurized gaseous fluid from the gas pressure source 62 at a first pressure and deliver the gaseous fluid to the gas portion 54 of the gas spring accumulator 52 at a second pressure. In the preferred non-limiting embodiment the second pressure is greater than said first pressure. In a most preferred embodiment the first pressure is at least about 500 pounds per square inch and the second pressure is up to about 5,800 pounds per square inch.

The active heave compensation assembly generally designated at 70 includes means for providing active coordinated reciprocal movement between the payload position and the destination position. The means for providing active coordinated reciprocal movement generally includes a secondary hydraulic power unit 72 for supplying pressurized liquid to a secondary hydraulic motor 74, said secondary hydraulic power unit fluidly coupled to said secondary hydraulic motor via a secondary supply tube 76. The secondary hydraulic motor is mechanically connected to said drum 12 for providing selective power assisted rotational movement thereto. A servo-valve 76 is fluidly connected along said secondary supply tube 78 preferably between said secondary hydraulic power unit 72 and said secondary hydraulic motor, the servo-valve having a controller 80 for generating a signal to said servo-valve in response to data received from at least one sensory input 82, wherein pressurized fluid supplied by said secondary hydraulic unit 72 is allowed to flow to said secondary hydraulic motor 74 for rotation thereof. Suitable controllers and sensory inputs are well known in the art and may include, but should not be limited to controllers and sensors constructed and arranged to monitor drum acceleration, drum position, drum speed, gas spring piston position, payload acceleration, payload deceleration, gas intensifier pressure, stored fluid pressure, directional control valve position, pressurized fluid pressure, suitable combinations thereof and the like. The active heave compensation assembly 70 may also include a booster accumulator 84 connected along the secondary supply tube 78 between the secondary power unit 72 and the servo-valve 76. The booster accumulator is constructed and arranged to maintain a supply of pressurized fluid during operation of the secondary power supply 72. The booster accumulator includes a variable volume gas portion 86 and a variable volume oil portion 88, the gas portion and the oil portion being separated by a piston member 90.

It should also be noted that while the preferred non-limiting embodiment disclosed herein fluidly connects the hydraulic components using tubing alternative means suitable for connecting hydraulic accessories which are well known in the art including, but not limited to hoses, pipes, manifolds, castings and suitable combinations thereof are also contemplated and may be utilized to connect the hydraulic components of the instant invention.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An active over passive coordinated motion winch device for use in a marine environment to position a payload and neutralize relative movement between said payload position and a destination position comprising:

a winch assembly including a drum, said drum having a hub defining an axis of rotation and a pair of flanges at opposing ends of said hub and perpendicular to said axis of rotation;

a control assembly constructed and arranged to selectively and operatively engage said winch assembly whereby variable torque and rotational speed or free rotation of said drum is provided;

a passive heave compensation assembly mechanically and fluidly connected with said control assembly, said passive heave compensation assembly including means for providing passive coordinated reciprocal movement between said payload position and said destination position;

an active heave compensation assembly mechanically connected to said winch assembly, said active heave compensation assembly including means for providing active coordinated reciprocal movement between said payload position and said destination position;

whereby said passive heave compensation assembly and said active heave compensation assembly cooperate with said winch assembly to reciprocally adjust the instantaneous payload position thereby neutralizing the relative movement between said payload position and said destination position.

2. The coordinated motion winch in accordance with claim 1 wherein said control assembly includes:

a main hydraulic power unit for supplying pressurized liquid to a primary hydraulic motor, said main hydraulic power unit fluidly coupled to said primary hydraulic motor via a primary supply tube, said primary hydraulic motor mechanically connected to said drum for providing selective power assisted rotational movement thereto.

3. The coordinated motion winch in accordance with claim 2 wherein said control assembly further includes a directional control valve, said directional control valve fluidly connected along said primary supply tube between said main hydraulic power unit and said primary hydraulic motor;

whereby operation of said directional control valve in a first direction permits a pressurized liquid to flow from said hydraulic power unit to said primary hydraulic motor, via said primary supply tube, to rotate said primary hydraulic motor in a first direction and whereby operation of said directional control valve in a second direction permits a pressurized liquid to flow from said hydraulic power unit to said primary hydraulic motor, via said primary supply tube, to rotate said primary hydraulic motor in a second direction.

4. The coordinated motion winch in accordance with claim 3 wherein, said directional control valve is a infinitely variable positioning three way valve.

5. The coordinated motion winch in accordance with claim 3 wherein, said directional control valve is a infinitely variable positioning four way valve.

6. The coordinated motion winch in accordance with claim 3 wherein said means for providing passive coordinated reciprocal movement between said payload position and said destination position includes a gas spring accumulator, said gas spring accumulator having a variable volume gas portion and a variable volume oil portion, said gas portion and said oil portion being separated by a piston member, said gas portion fluidly coupled to an infinitely variable gas pressure source via a gas supply tube, said oil portion fluidly coupled to said primary supply tube between said primary hydraulic motor and said directional control valve;

wherein said gas spring acts to passively dampen response of said winch drum thereby reducing relative movement between said payload position and destination position.

7. The coordinated motion winch in accordance with claim 6 wherein said means for providing passive coordinated reciprocal movement between said payload position and said destination position includes a gas intensifier fluidly connected to said gas supply tube between said gas pressure source and said gas portion of said gas spring accumulator;

whereby a gaseous fluid is supplied from said gas pressure source to said gas intensifier at a first pressure and said gaseous fluid is delivered from said gas intensifier to said gas portion of said gas spring accumulator at a second pressure.

8. The coordinated motion winch in accordance with claim 7 wherein said second pressure is greater than said first pressure.

9. The coordinated motion winch in accordance with claim 8 wherein said first pressure is at least about 500 pounds per square inch.

10. The coordinated motion winch in accordance with claim 8 wherein said second pressure is up to about 5,800 pounds per square inch.

11. The coordinated motion winch in accordance with claim 6 wherein said gas pressure source includes at least one tank containing pressurized fluid.

12. The coordinated motion winch in accordance with claim 1 wherein said means for providing active coordinated reciprocal movement between said payload position and said destination position includes a secondary hydraulic power unit for supplying pressurized liquid to a secondary hydraulic motor, said secondary hydraulic power unit fluidly coupled to said secondary hydraulic motor via a secondary supply tube, said secondary hydraulic motor mechanically connected to said drum for providing selective power assisted rotational movement thereto.

13. The coordinated motion winch in accordance with claim 12 including a servo-valve fluidly connected along said secondary supply tube between said secondary hydraulic power unit and said secondary hydraulic motor, said servo-valve having a controller for generating a signal to said servo-valve in response to data received from at least one sensory input, wherein a pressurized fluid supplied by said secondary hydraulic unit is allowed to flow to said secondary hydraulic motor for rotation thereof in response to data received from said at least one sensory input;

whereby said servo-valve dynamically operates said secondary hydraulic motor in cooperation with said passive heave compensation assembly to neutralize relative movement between said payload position and said destination position.

14. The coordinated motion winch in accordance with claim 13 including a booster accumulator connected along said secondary supply tube between said secondary power unit and said servo-valve, said booster accumulator having a variable volume gas portion and a variable volume oil portion, said gas portion and said oil portion being separated by a piston member;

wherein said booster accumulator maintains a supply of pressurized fluid during operation of said secondary power supply.

15. The coordinated motion winch in accordance with claim 13 wherein said at least one sensory input receives data selected from the group consisting of drum acceleration, drum position, drum speed, gas spring piston position, payload acceleration, payload deceleration, gas intensifier pressure, stored fluid pressure, manual control valve position, pressurized fluid pressure or combinations thereof.

* * * * *